US006022237A

United States Patent [19]

Esh

[11] Patent Number: 6,022,237

[45] Date of Patent: Feb. 8, 2000

[54] WATER-RESISTANT ELECTRICAL CONNECTOR

[75] Inventor: John O. Esh, 3742 E. Newport Rd., Gordonville, Pa. 17529

[73] Assignee: John O. Esh, Gordonville, Pa.

[21] Appl. No.: 09/021,021

[22] Filed: Feb. 9, 1998

Related U.S. Application Data

[60] Provisional application No. 60/038,906, Feb. 26, 1997.

[51] Int. Cl.[7] ..... H01R 4/50

[52] U.S. Cl. ..... 439/348; 439/597

[58] Field of Search ..... 439/271, 275, 439/278, 279, 280, 281, 283, 348, 923, 597–600

[56] References Cited

U.S. PATENT DOCUMENTS

| | | | |
|---|---|---|---|
| 2,962,688 | 11/1960 | Werner | 439/320 |
| 3,188,100 | 6/1965 | Delgado . | |
| 3,297,975 | 1/1967 | Pope | 439/282 |
| 3,564,477 | 2/1971 | Pompei | 439/17 |
| 3,611,255 | 10/1971 | Shroyer | 439/282 |
| 3,649,949 | 3/1972 | McCarthy et al. | 439/194 |
| 4,456,320 | 6/1984 | Gallusser et al. | 439/271 |
| 4,493,520 | 1/1985 | Davies | 439/350 |
| 4,768,970 | 9/1988 | Nester | 439/278 |
| 5,362,258 | 11/1994 | Arnswald et al. | 439/695 |
| 5,368,499 | 11/1994 | Hirt | 439/350 |
| 5,376,013 | 12/1994 | Sawada | 439/271 |
| 5,505,634 | 4/1996 | Osten | 439/369 |

FOREIGN PATENT DOCUMENTS

| | | |
|---|---|---|
| 2436534 | 2/1976 | Germany . |
| 4308664 | 9/1993 | Germany . |
| 54-44371 | 4/1979 | Japan . |
| 4-123773 | 4/1992 | Japan . |
| 5-166563 | 7/1993 | Japan . |
| 8202621 | 1/1984 | Netherlands . |
| 432279 | 8/1975 | U.S.S.R. . |
| 1288794 | 2/1987 | U.S.S.R. . |
| 1339699 | 9/1987 | U.S.S.R. . |
| 490013 | 8/1938 | United Kingdom . |
| 2049308 | 12/1980 | United Kingdom . |

OTHER PUBLICATIONS

An article entitled *Silver for Industrial Uses*, by Handy & Harman, Apr., 1956, p. 220 in a magazine entitled *Electrical Manufacturing*.

*Primary Examiner*—Lincoln Donovan
*Attorney, Agent, or Firm*—Litman Law Offices; Richard C Litman

[57] ABSTRACT

A water-resistant, insulated electrical connector for maintaining a secure connection therebetween to ensure uninterrupted current flow between male and female endpieces. The male endpiece features a double cylinder base with at least one O-ring and an annular groove. Electrical prongs project from the end of the male endpiece. The female endpiece has a lip at one end and features a cylindrical base, a cylindrical enclosure and a spring-biased sleeve which slidably engages the cylindrical base. The sleeve is manually retractable. A plurality of balls are loosely retained within and protrude from respective cavities defined by the inner surface of the cylindrical enclosure in an annular formation. The female endpiece defines sockets to receive the electrical prongs in well known fashion. Coupling of the male and female endpieces enables the insertion of the prongs into their respective sockets. The sleeve is then manually displaced toward the male endpiece, ultimately causing the balls to insertably engage the annular groove and lock into place to releasably secure the male and female endpieces together. The O-ring structure of the device enables a secure water-resistant seal. The lip, having been slid over and deposed past the O-ring, further secures the male and female endpieces together. Manually displacing the sleeve in the opposite direction disengages the balls from the annular groove to uncouple the male and female endpieces.

7 Claims, 3 Drawing Sheets

WATER-RESISTANT ELECTRICAL CONNECTOR

CROSS-REFERENCE TO RELATED APPLICATION

This application claims the benefit of U.S. Provisional Patent Application Serial No. 60/038,906, filed Feb. 26, 1997.

BACKGROUND OF THE INVENTION

1. Field of the Invention

The present invention relates to electrical connector devices and more specifically, to male-female electrical device incorporating connective electrical elements and having water-resistant properties.

2. Description of the Prior Art

Conventional electrical plugs include a plurality of electrically conductive prongs extending outward from the body for connecting to or plugging into receiving slots or sockets of an electric outlet or like receptacle. The use of electrically-operated equipment in diverse hostile environments has warranted the development of protective devices for encapsulating the connective elements of electrical power cords. Many of these devices are designed to insulate electrical components from moisture while also maintaining a secure connection between them to ensure uninterrupted current flow. Several structural and mechanical variations of these devices exist. The prior art is represented by the following patents of interest.

U.S. Pat. No. 2,962,688, issued on Nov. 29, 1960 to Georg Werner, describes a plug-in cable connector. Werner does not suggest a water-resistant electrical connector according to the claimed invention.

U.S. Pat. No. 3,188,100, issued on Jun. 8, 1965 to Manuel M. Delgado, describes a clad metal seal with a clad sealing malleable metal rib. Delgado does not suggest a water-resistant electrical connector according to the claimed invention.

U.S. Pat. No. 3,297,975, issued on Jan. 10, 1967 to Gary L. Pope, describes a sleeved coupling for electrical cables featuring insulating sleeves adapted for securance to electrical connectors to prevent relative movement therebetween. Pope does not suggest a water-resistant electrical connector according to the claimed invention.

U.S. Pat. No. 3,564,477, issued on Feb. 16, 1971 to Salvatore J. Pompei, describes an antifriction bearing equipped with an electrically conductive seal. Pompei does not suggest a water-resistant electrical connector according to the claimed invention.

U.S. Pat. No. 3,611,255, issued on Oct. 5, 1971 to Larry L. Shroyer, describes a moisture resistant electrical connector comprising two hollow members, the first containing the prongs of an electrical cord and the second containing the prong-receiving sockets of an electrical cord. The second member is designed for insertion into the first member, having an exterior series of ridges and grooves that engage complementary surface articulations on the interior of the first member. These interlocking ridges and grooves enhance moisture resistance and mechanical connection aspects of the Shroyer electrical connector. Shroyer does not suggest a water-resistant electrical connector according to the claimed invention.

U.S. Pat. No. 3,649,949, issued on Mar. 14, 1972 to James W. McCarthy et al., describes a quick connect-disconnect coupled adapted to simultaneously convey gas and electrical energy to an installation submerged in a liquid body. Ball locking means on a movable outer sleeve of the device stabilize the operational connection between its male and female coupling members. McCarthy et al. do not suggest a water-resistant electrical connector according to the claimed invention.

U.S. Pat. No. 4,456,320, issued on Jun. 26, 1984 to David O. Gallusser et al., describes a moisture seal for an electrical connector assembly. Gallusser et al. do not suggest a water-resistant electrical connector according to the claimed invention U.S. Pat. No. 4,493,520, issued on Jan. 15, 1985 to Jeffrey N. Davies, describes an electrical connector device having inner and outer mating connector members that contain and insulate plug and socket electrical contact elements. A cylindrical sleeve on the outer connector member moves axially with respect to another cylindrical sleeve on the inner connector member. Both cylindrical sleeves incorporate grooves, which in turn retain ball-spring assemblies that facilitate the locking and unlocking of the movable outer cylindrical sleeve. The locking mechanism secures the connection between the connector members, and allows one to easily disengage the connector members, when desired. Unfortunately, the groove in the outer cylindrical sleeve exposes the ball-spring assemblies, increasing the risk of accidentally damaging or permanently dislodging them. Davies does not suggest a water-resistant electrical connector according to the claimed invention.

U.S. Pat. No. 5,368,499, issued on Nov. 29, 1994 to Ingo Hirt, describes a multi-lead electric plug connector which employs an O-ring for forming a water-tight seal that insulates mated plug and socket components of an electrical cord. A plug-supporting member having an oval cross section incorporates cams that engage corresponding recesses on a socket-supporting member, which also has an oval cross section, to establish an operational connection therebetween. The space constraints imposed by the oval cross section of the plug-supporting member can only accommodate two-pronged plugs. Unlike support members having a circular cross section, the oval structure of the connector described in Hirt cannot accommodate a third grounding prong. Hirt does not suggest a water-resistant electrical connector according to the claimed invention.

U.S. Pat. No. 5,376,013, issued on Dec. 27, 1994 to Hisashi Sawada, describes a connector with a waterproof rubber ring provided on the inner surface of an engaging hole formed in a housing of a female connector so as to seal the space between the inner surface of the engaging hole and the outer surface of a housing of a male connector inserted into the housing of the female connector. Sawada does not suggest a water-resistant electrical connector according to the claimed invention.

U.S. Pat. No. 5,505,634, issued on Apr. 9, 1996 to Frederick F. Osten, describes a cord connector which includes first and second substantially hollow receptacle-like member with each of the members having a side wall and a first end with an opening for circumferentially encompassing an electrical cord, and with each of the walls being shaped in the form of a thread so that an outside surface of each of the walls has a male thread and so that an inside surface of each of the walls has a female thread. Osten does not suggest a water-resistant electrical connector according to the claimed invention.

German Patent document 2,436,534, published on Feb. 12, 1976, describes a waterproof connector for electrical cable contacts that has an integral flexible projecting sealing ring for protecting the contacts. German '534 does not suggest a water-resistant electrical connector according to the claimed invention.

German Patent document 4,308,664, published on Sep. 30, 1993, describes an electrical connector plug with a rubber ring seal including a number of flexible rings that ensures the ring cannot be compressed on insertion of the plug into a mating socket. German '664 does not suggest a water-resistant electrical connector according to the claimed invention.

Great Britain Patent document 490,013, published on Aug. 5, 1938, describes an electrical coupling for interconnecting plug and socket units. The plug and socket components each incorporate exterior annular flanges that interlock at the interface of the plug-socket connection. This placement and the resultant mechanical instability of the deformable interlocking flanges, however, compromise the connection established by the device and minimize its moisture protection capabilities. Great Britain '013 does not suggest a water-resistant electrical connector according to the claimed invention.

Great Britain Patent document 2,049,308, published on Dec. 17, 1980, describes a waterproof electrical plug and socket assembly wherein ingress of water into the assembly is prevented by radial sealing means. The sealing means is resilient and annular and may comprise one, two or more O-ring s. Great Britain '308 does not suggest a water-resistant electrical connector according to the claimed invention.

Japan Patent document 54-44731, published on Apr. 7, 1979, describes a waterproof socket for a fluorescent lamp, in which an inner peripheral surface of a cylindrical lamp packing is forced into tight contact with the outer peripheral surface of the lamp, and one end of the lamp packing is held in tight contact with the base peripheral portion of a cylindrical socket, so as to seal the lamp pin guide groove in a water-tight manner. Japan '731 does not suggest a water-resistant electrical connector according to the claimed invention.

Japan Patent document 4-123773, published on Apr. 23, 1992, describes a waterproof connection between male and female connector parts, wherein the forward end of the male connector part is applied to a disc-like seal disposed in a bottom part of a hood of a female connector part, and a forward end of the female connector part is applied to a ring-like seal disposed close to an installation part of the male connector part and a locking hood. Japan '773 does not suggest a water-resistant electrical connector according to the claimed invention.

Japan Patent document 5-16653, published on Jul. 2, 1993, describes a waterproof connection between male and female connector parts, wherein a male connector part is fitted into a fitting recessed portion of a female connector part and the opening of the fitting recessed portion is blocked by a waterproof sheet and the waterproof sheet is fastened together with a back retainer by the hook piece of the male connector part. Japan '653 does not suggest a water-resistant electrical connector according to the claimed invention.

Netherlands Patent document 8,202,621, published on Jan. 16, 1984, describes a multi-way connector plug with a cylindrical metal body and a multi-pin insert that makes contact with a mating insert in a socket. Water is excluded from the connection by a compressed sealing ring and an O-ring. Netherlands '621 does not suggest a water-resistant electrical connector according to the claimed invention.

Soviet Union Patent document 432,279, published on Aug. 8, 1975, describes a downhole instrument logging cable connector. Soviet Union '279 does not suggest a water-resistant electrical connector according to the claimed invention.

Soviet Union Patent document 1,288,794, published on Feb. 7, 1987, describes a deep water electrical plug and socket connector that has elastic insulators positioned between the contact elements. Soviet Union '794 does not suggest a water-resistant electrical connector according to the claimed invention.

Soviet Union Patent document 1,339,699, published on Sep. 23, 1987, describes an overboard submerged electrical instrument cable plug including a convex seal interacting with an annular projection which has a sharp edge for increasing electrical resistance. Soviet Union '699 does not suggest a water-resistant electrical connector according to the claimed invention.

An article entitled *Silver for Industrial Uses,* published in the April, 1956 magazine entitled *Electrical Manufacturing*, describes a quick connect, quick disconnect electrical connector designed with the use of spherical balls and an annular groove. The article does not suggest a water-resistant electrical connector according to the claimed invention.

None of the above inventions and patents, taken either singly or in combination, is seen to describe the instant invention as claimed.

SUMMARY OF THE INVENTION

The present invention aims to overcome the shortcomings of the above cited inventions and patents. The present invention incorporates water-resistant, insulated electrical components while maintaining a secure connection therebetween to ensure uninterrupted current flow. Furthermore, the ease of engaging and disengaging the device, its self-protective structure and its versatility make it more favorable for use in various applications.

The present invention comprises male and female endpieces which are disposed to engage a male plug and a female plug, respectively, for ensuring a secure, water-tight electrical connection therebetween.

The male endpiece engages either an auxiliary extension cord, or the terminus of an appliance or tool electrical cord. Two O-rings engage the cylindrical body of the male endpiece with an annular groove disposed at a point between and equidistant to the O-rings. In the preferred embodiment of the invention, rectangular contact prongs and a grounding prong project from the end of the cylindrical body in well-known fashion.

The female endpiece comprises a substantially cylindrical body that engages one end of an auxiliary extension cord. Alternatively, the female endpiece can be incorporated a wall outlet design. The female endpiece further comprises a substantially cylindrical spring-actuated sleeve which slidably engages the cylindrical body. The cylindrical sleeve can be manually retracted along the cylindrical member, and returns to its natural position when released.

Opposing annular recesses in the cylindrical body and the biased cylindrical sleeve define an annular cavity that contains a spring, oriented parallel to the cylindrical body. The spring biases the cylindrical sleeve and facilitates the retractable motion of the cylindrical sleeve.

The female endpiece incorporates a substantially cylindrical enclosure, farthest from its frusto-conical end, which receives the small cylindrical member therein. A plurality of balls are loosely retained within and protrude from respective cavities, defined by the surface of cylindrical enclosure in an annular formation. An annular groove within the cylindrical sleeve accommodates the balls, when aligned with the cavities. The annular groove is shaped so that the border closest to the frusto-conical end slopes at a downward angle as it approaches the small cylindrical member. A lip annularly engages the exterior circumference of the female endpiece at the end farthest from its frusto-conical end.

Coupling of the male and female endpieces enables the insertion of the prongs into their respective sockets. The cylindrical sleeve is then manually displaced so that the inner surface of the cylindrical sleeve slides over the O-ring s until the balls insertably engage the annular groove, locking the balls into place along the annular groove to releasably secure the male and female endpieces together. The double O-ring structure of the device enables a more secure water-resistant seal. The lip, having been slid over and deposed past the O-ring s, further secures the male and female endpieces together. Manual displacement of the cylindrical sleeve away from the larger cylindrical member disengages the balls from the annular groove when the uncoupling of the male and female endpieces is desired. In an alternative embodiment of the invention, the elements of the female endpiece described above can be incorporated into a wall outlet design. In this embodiment, elements of female endpieces are included in the wall outlet design and operate to receive and engage male endpieces in the same way as described above, where the male endpieces can be the terminuses of auxiliary extension cords or of appliance or tool electrical cords. The secure locking mechanism and the waterproof seal described above are provided in the wall outlet design as well.

Accordingly, it is a principal object of the invention to provide a water-resistant electrical connector device of simple construction and operation.

It is another object of the invention to encase all components of the electrical connector, for protecting them from exposure to a hostile environment and against resultant damage or loss.

It is a further object of the invention to provide means for connecting with male plug components having different prong formations.

Still another object of the invention is to ensure that the electrical connector is easy to use, and does not require the expenditure of great energy to engage or disengage the components.

It is also an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
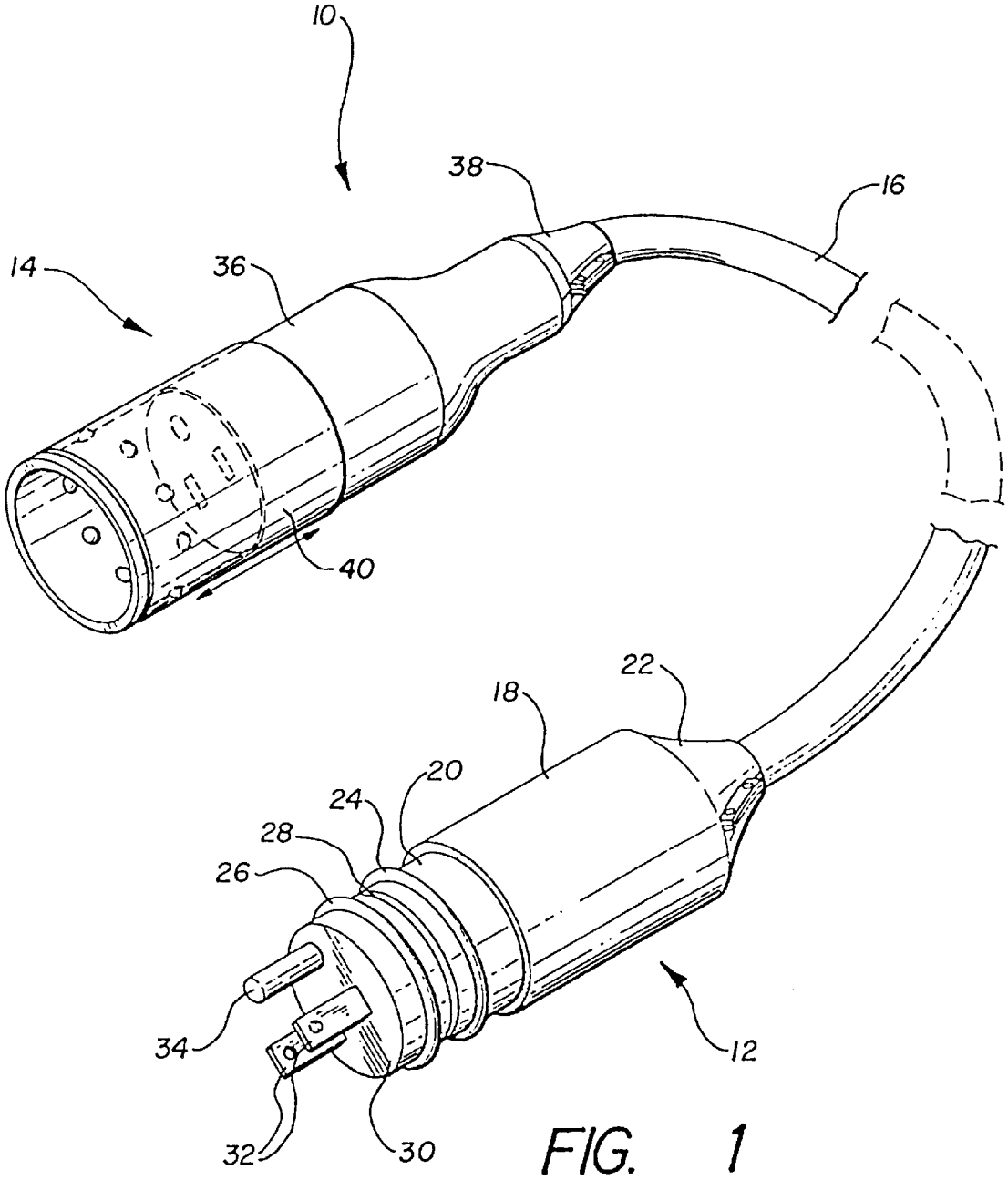
FIG. 1 is a perspective view of an electrical cord with a male end and a female end according to the present invention.
Figure 2:
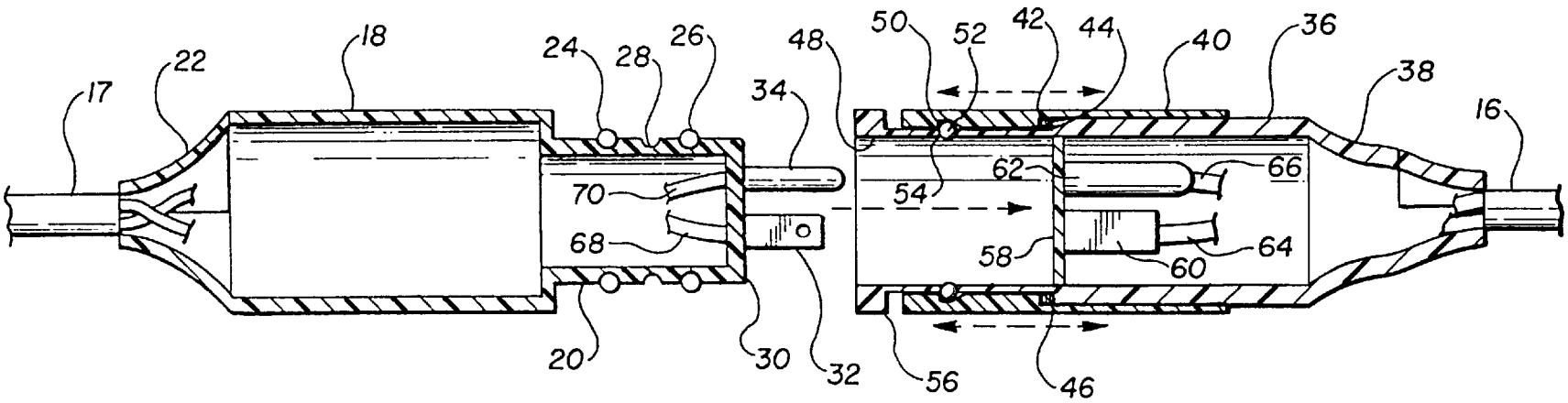
FIG. 2 is a longitudinal, cross-sectional view of a male end and a female end according to the present invention connected together.
Figure 3:
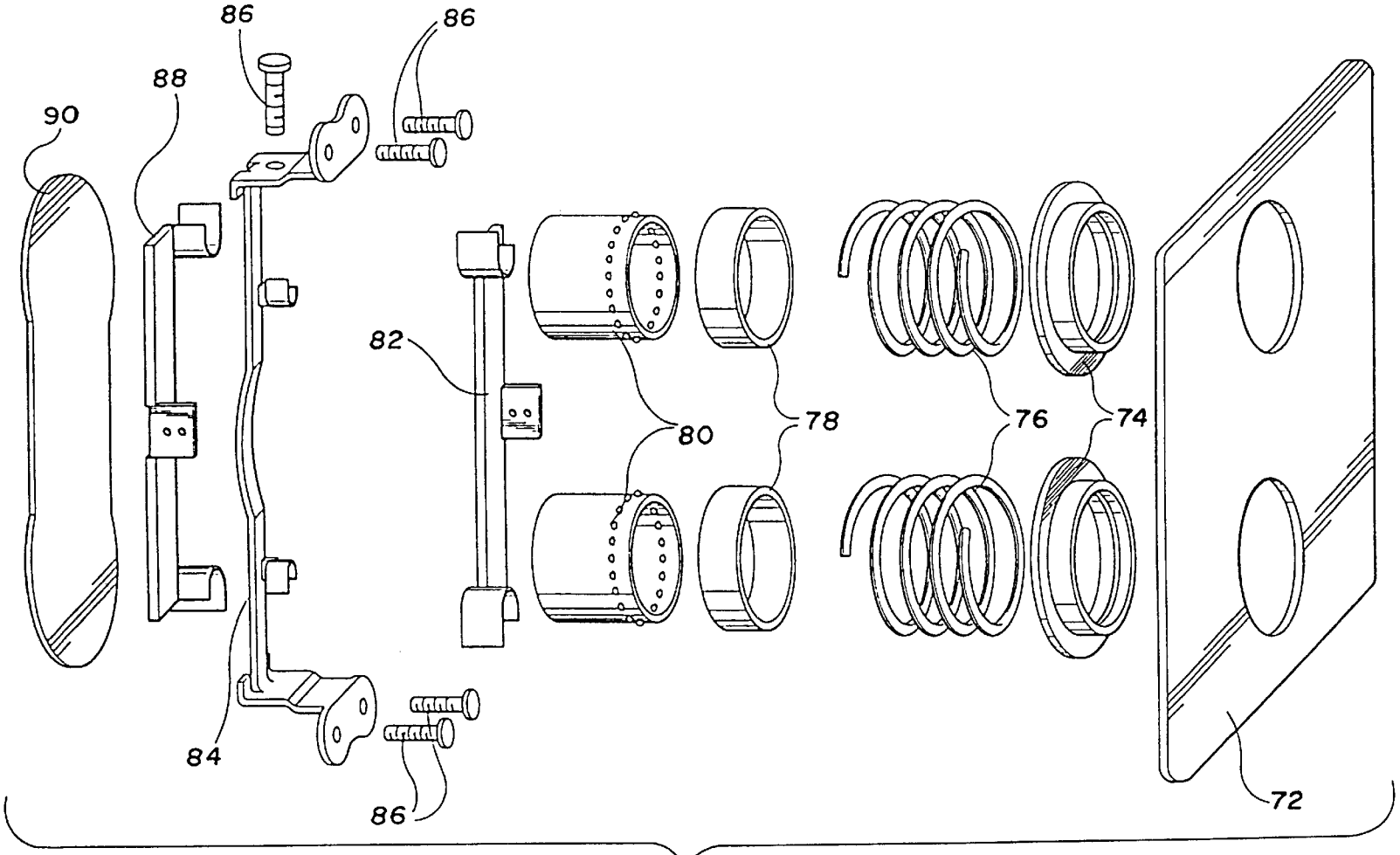
FIG. 3 is an exploded view of an outlet receptacle according to the present invention.

Referring initially to FIGS. 1 and 2, elements of the inventive water-resistant electrical connector are shown and are generally indicated by the reference numeral 10. The elements of the inventive water-resistant electrical connector 10 include a male endpiece 12 and a female endpiece 14, each constructed from non-conductive, water-resistant materials. Male and female endpieces 12,14 can be connected via an auxiliary extension cord 16 therebetween, as shown in FIG. 1. Male endpiece 12 can also connect to an appliance or tool electrical cord 17, with female endpiece 14 acting as the receiving terminus of an auxiliary extension cord 16, as shown in FIG. 2. Alternatively, the elements of the inventive female endpiece can be incorporated into a wall outlet design, as shown in FIG. 3.

As shown in FIG. 1, the male endpiece 12 comprises two substantially cylindrical members 18,20, which integrally connect in an end-to-end formation. The large cylindrical member 18 has a frusto-conical end 22 that tapers away from cylindrical member 18. The frusto-conical end 22 surrounds and sealingly engages one end of an auxiliary extension cord 16, or the terminus of an appliance or tool electrical cord 17, as shown in FIG. 2. The end of the extension cord or appliance cord must be removed prior to connection of the male endpiece 12.

At least one O-ring is included as a sealing means to surround the small cylindrical member 20 of the male endpiece. In FIGS. 1 and 2, two O-ring s 24,26 are shown secured within grooves surrounding the small cylindrical member 20, and deposed at points substantially one third and two thirds along its length. An annular groove 28 encircles the small cylindrical member 20 at a location between and equidistant to the O-rings 24,26. A plurality of contact prongs project perpendicularly from a circular surface 30 of the small cylindrical member 20. Two flat, substantially rectangular contact prongs 32 and a grounding contact prong 36, having substantially a cylindrical cross section, project from the circular surface 30 in well-known fashion.

The female endpiece 14 comprises a substantially cylindrical member 36 that has a frusto-conical end 38. Frusto-conical end 38 surrounds and sealingly engages one end of an auxiliary extension cord 16. The female endpiece 14 further comprises a substantially cylindrical sleeve 40 having an inner circumference substantially equal to the outer circumference of cylindrical member 36. Cylindrical sleeve 40 is spring biased and axially slidable along the length of cylindrical member 36. In its biased position, the cylindrical sleeve 40 lies farthest from frusto-conical end 38. The cylindrical sleeve 40 can be manually retracted along the cylindrical member 36, towards frusto-conical end 38. FIG. 2 shows the cylindrical sleeve 40 in a retracted position. When released, the cylindrical sleeve 40 returns to a biased position, as shown in FIG. 1.

FIG. 1 illustrates the interior components of the female endpiece 14 in dashed lines. Now referring to FIG. 2, the inner surface of the sleeve 40 incorporates a substantially annular recess 42. The cylindrical member 34 defines a substantially annular recess 44. Recesses 42 and 44 possess substantially similar dimensions, and counter each other to form an annular cavity when the cylindrical sleeve 40 is in the biased position. The annular cavity contains a cylindrical spring 46, oriented parallel to the cylindrical member 36. The spring 46 biases the cylindrical sleeve 40 as previously discussed and facilitates the retractable motion of the cylindrical sleeve 40, as illustrated by the double-headed arrows in FIGS. 1 and 2.

The cylindrical member 36 defines a substantially cylindrical enclosure 48 at an end remote from the frusto-conical end 38. The cylindrical enclosure 48 is of dimensions as to allow the insertion of a small cylindrical member 20 from a male endpiece therein. A plurality of balls 52 are loosely retained within and protrude from respective cavities 54, defined by the surface of the cylindrical enclosure 48 in an annular formation. The cylindrical sleeve 40 defines an annular groove 50, which accommodates balls 52 when aligned with cavities 54. A lip 56 annularly engages the exterior circumference of the cylindrical member 36 at the end farthest from the frusto-conical end 38.

The cylindrical member 36 further comprises an interior circular surface 58. The circular surface 58 defines a pair of rectangular sockets 60 and a circular socket 62 to receive rectangular prongs 32 and grounding prong 34 of a male endpiece, respectively, in well known fashion. Wires 64,66 within the female endpiece represent the operational electrical connections from rectangular sockets 60 and circular socket 62, respectively, through cylindrical member 36 and along the length of auxiliary extension cord 16, ultimately engaging a power source. Likewise, wires 68,70 within the male endpiece extend from the rectangular prongs 32 and the grounding prong 34, respectively, through cylindrical members 20,18 and along the length of an appliance or tool electrical cord 17 or an auxiliary extension cord 16, depending on the embodiment. Additionally, the frusto-conical ends 22,38 are bifurcated and open to facilitate wire placement therethrough. Screws secure the halves of the frusto-conical ends together after wire installation for the purpose of providing a sealed connection, as shown in FIG. 1. Alternatively, the frusto-conical ends may be retrofittedly connected to an electrical cord in known manner.

Operation of the present invention involves the initial coupling of the male and female endpieces 12,14 as indicated by the one-headed arrow in FIG. 2. Specifically, the small cylindrical member 20 insertably engages the cylindrical enclosure 48, so that the rectangular prongs 32 and the grounding prong 34 of the male endpiece insert into the rectangular sockets 60 and the circular socket 62 of the female endpiece, respectively. At this point, circular surfaces 30 and 58 abut each other. As small the cylindrical member 20 insertably engages the cylindrical enclosure 48, the inner surface of cylindrical enclosure 48 slides over O-rings 24,26 until the balls 52 insertably engage the annular groove 28. The cylindrical sleeve 40 is then manually displaced towards the frusto-conical end 38. Cylindrical sleeve 40 is then released, unable to retract fully, as balls 52 lock into place along annular groove 28 to releasably secure the male and female endpieces together. The double O-ring structure of the device enables a more secure water-resistant seal. Lip 56, having been slid over and deposed past O-rings 24,26, further secures the male and female endpieces 12,14 together. Manual displacement of cylindrical sleeve 40 away from the cylindrical member 18 disengages the balls 52 from the annular groove 28 when the uncoupling of male and female endpieces 12,14 is desired.

In an alternative embodiment of the invention, the elements of the female endpiece 14 shown in FIG. 1 can be incorporated into a wall outlet design, as shown in exploded view in FIG. 3. In this embodiment, elements of female endpieces are included in the wall outlet design and operate to receive and engage male endpieces in the same way as described above, where the male endpieces can be the terminus of auxiliary extension cords or of appliance or tool electrical cords. The secure locking mechanism and the waterproof seal described above are provided in the wall outlet design as well.

The wall outlet design includes a rectangular outlet wall plate 72 including two circular openings which cover two outlet receptacles. The outlet receptacles are structurally mounted on an electrically non-conductive base plate 90. The outlet receptacles include two short electrically non-conductive cylindrical elements 74 with flange extensions that prevent the cylindrical elements 74 from being extracted from the wall plate 72. Each cylindrical element 74 includes an annular groove to receive balls loosely retained within two long electrically nonconductive cylindrical members 80.

The cylindrical members 80 each define a substantially cylindrical enclosure having dimensions that allow the insertion of a small cylindrical member from a male endpiece therein. A plurality of balls are loosely retained within and protrude from respective cavities in the cylindrical members 80. The annular grooves in each cylindrical element 74 accommodate the balls loosely retained within long cylindrical members 80 when aligned with the cavities.

The cylindrical elements 74 are spring biased and axially slidable along the length of cylindrical members 80. The spring biasing occurs by cylindrical springs 76, which are each oriented parallel to a cylindrical member 80, and disposed between cylindrical elements 74 and cylindrical elements 78. The cylindrical elements 78 are electrically non-conductive and are mounted on the base plate 90. The cylindrical elements 74, cylindrical springs 76, and cylindrical elements 78 each have an inner circumference substantially equal to the outer circumference of the cylindrical members 80. The springs 76 bias the cylindrical elements 74 as previously discussed and facilitate the retractable motion of the cylindrical sleeve 74, In their biased positions, the flange extensions of the cylindrical elements 74 are pressed against the inside wall of the wall plate 72. The cylindrical elements 74 can each be manually depressed along a cylindrical member 80, towards the base plate 90.

The outlet receptacles further comprise metal socket elements 82, 84, and 88. Socket elements 82 and 88 are mounted on lateral sides of the base plate 90 and each include socket portions for receiving rectangular prongs from a male endpiece. Socket elements 82 and 88 include center portions for receiving operational electrical connections from the wall. Socket element 84 is a grounded piece of metal and is mounted in the center of the base plate 90. The socket element 84 includes two circular socket portions for receiving a circular grounding prong of a male endpiece. Fastening elements 86 are employed to secure socket element 84 in place.

It is to be understood that the present invention is not limited to the embodiments described above, but encompasses any and all embodiments within the scope of the following claims.

I claim:

1. A water-resistant electrical connector comprising:

a male endpiece comprising cylindrical first and second portions, said first portion having a smaller diameter than said second portion and integrally connected thereto in an end-to-end formation, and said first portion incorporating plug contact elements and exterior surface articulating means for establishing and maintaining a water-resistant seal; and a female endpiece comprising a cylindrical member and a cylindrical sleeve, said cylindrical sleeve slidably engaging said cylindrical member, said cylindrical member incorporating socket means for receiving said plug contact elements of said male endpiece and a lip member circumferentially engaging one end thereof, and said cylindrical sleeve comprising interior surface articulating means for establishing and maintaining a water-resistant seal with said male endpiece, wherein said female endpiece defines a substantially cylindrical enclosure, said cylindrical enclosure having dimensions as to allow the insertion of a first cylindrical member therein and a surface defining a plurality of cavities in an annular formation, said cavities loosely retaining a plurality of balls, wherein said cylindrical sleeve has an annular groove, said annular groove accommodating said balls when aligned with said cavities, thus to enable disengagement between said male and said female endpieces.

2. The water-resistant electrical connector according to claim 1, wherein said exterior surface articulating means for establishing and maintaining a water-resistant seal include at least one O-ring seal, spaced apart and circumferentially disposed on said first portion, as well as said lip.

3. The water-resistant electrical connector according to claim 1, wherein said exterior surface articulating means for establishing and maintaining a water-resistant seal include two O-ring seals, spaced apart and circumferentially disposed on said first portion, as well as said lip.

4. The water-resistant electrical connector according to claim 3, wherein said interior surface articulating means for establishing and maintaining a water-resistant seal further include means defining a circumferential groove on said first portion, located between said O-ring seals.

5. The water-resistant electrical connector according to claim 1, wherein said female endpiece further comprises an annular cavity and a cylindrical spring, said annular cavity defined by and disposed between said cylindrical sleeve and said cylindrical member, and said cylindrical spring contained within said annular cavity and oriented parallel to said cylindrical member, whereby said cylindrical spring biases said cylindrical sleeve.

6. The water-resistant electrical connector according to claim 1, further comprising electrical cords operably engaging said male endpiece and said female endpiece, with connecting means for operably securing an electrical cord to said male endpiece and for operably securing an electrical cord to said female endpiece.

7. The water-resistant electrical connector according to claim 6, wherein said connecting means for operably securing an electrical cord to said male endpiece and for operably securing and electrical cord to said female endpieces comprises a frusto-conical end comprising a large opening, a small opening and two opposing half shells with means for securing said half shells together, whereby the large opening of said frusto-conical end circumferentially engages said male or said female endpiece, and said small opening engages an electrical cord, said half shells directing current-conveying wires from an electrical cord through to said male or said female endpiece to operably engage electrical components therein.

* * * * *